United States Patent [19]

Schock

[11] Patent Number: 4,639,734

[45] Date of Patent: Jan. 27, 1987

[54] SUPPORT STRUCTURE FOR PARABOLOID REFLECTOR

[76] Inventor: Edward J. Schock, 1000 Conestoga Rd. C-347, Rosemont, Pa. 19010

[21] Appl. No.: 602,348

[22] Filed: Apr. 20, 1984

[51] Int. Cl.[4] ..... H01Q 1/14; H01Q 15/16

[52] U.S. Cl. ..... 343/912; 343/840

[58] Field of Search ..... 343/912, 914, 915, 916, 343/878, 840; 248/351, 354.5, 220.1, 220.2; 52/656, 657, 646, 648, 633, 81, DIG. 10

[56] References Cited

U.S. PATENT DOCUMENTS 3,964,071 6/1976 Townes et al. ..... 343/912

4,127,347 11/1978 Pritchard ..... 52/657

OTHER PUBLICATIONS

Cooper, "Low Cost Backyard Satellite TV Earth Station", *Radio Electronics,* vol. 51, No. 2, Feb. 1980, pp. 47–52, 83.

*Primary Examiner*—Eli Lieberman

*Assistant Examiner*—Michael C. Wimer

[57] ABSTRACT

Support structure for a paraboloid reflector of electromagnetic radiation. The structure comprises a plurality of abutting flat ribs arranged on edge in rotated concentric square patterns, with the ends of inner ribs meeting the sides of adjacent outer squares at forty-five-degree angles. The concave parabolic forward edges of the ribs are aligned at their junctures, establishing the curve of a screen reflector. Corner gussets are positioned on parallel planes that are perpendicular to the focal axis of the paraboloid. The structure is assembled by inserting fasteners through matching holes in the ribs and corner gussets.

4 Claims, 6 Drawing Figures

SUPPORT STRUCTURE FOR PARABOLOID REFLECTOR

SUMMARY OF THE INVENTION

The invention relates to a support structure of non-slotted, abutting, flat ribs for a paraboloid reflector of electromagnetic radiation.

An object of the invention is to create a rigid, light-weight, economically and easily built support structure for a paraboloid reflector. A further object is to provide for easy and accurate assembly of the structure so that the components may be transported in a compact package and assembled on site.

THE PRIOR ART

The use of slotted flat ribs arranged on parallel and perpendicular planes to create or support a paraboloid reflector is known. In U.S. Pat. No. 2,423,648, issued on July 8, 1947, to Clarence W. Hansell, a parabolic reflector formed of two sets of plural slotted parallel strips, all cut from the same parabola, crossing at right angles, is described. A similar lattice arrangement is described in U.S. Pat. No. 3,886,557, issued to William E. Townes, Jr., and Stanley P. Svedeman on May 27, 1975. In the former patent, the lattice structure is the reflector. In the latter, a reflective screening is attached to the concave forward edges of the ribs. The present invention dispenses with the mating slots of crossing ribs by joining the ribs in abutment.

DETAILED DESCRIPTION OF THE INVENTION

Figure 1:
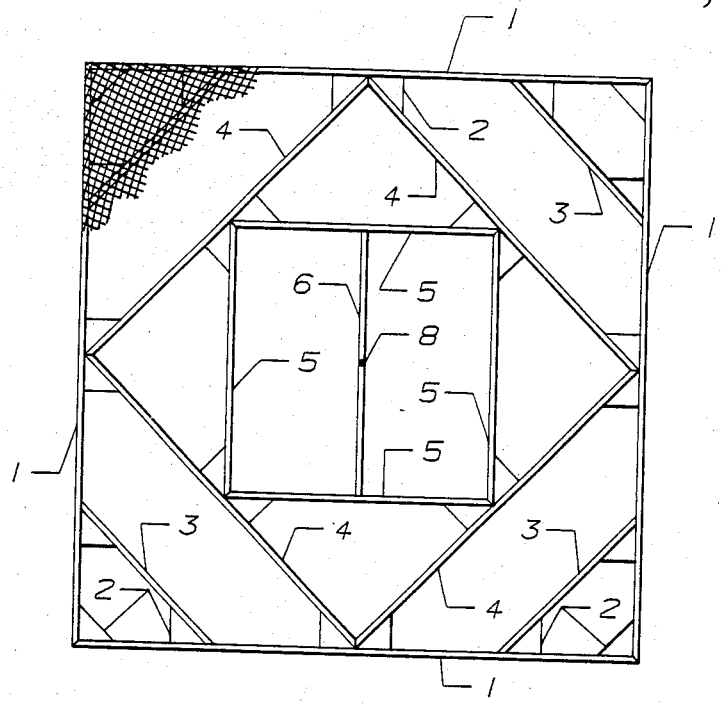
FIG. 1 is a front on elevational view of a support structure built in accordance with the invention.
Figure 3:
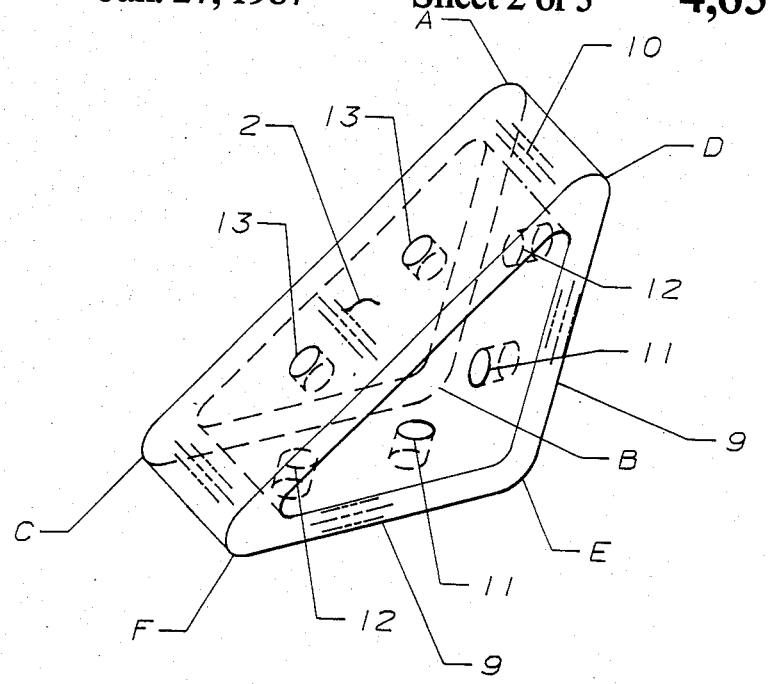
FIG. 3 depicts a corner gusset.
Figure 4:
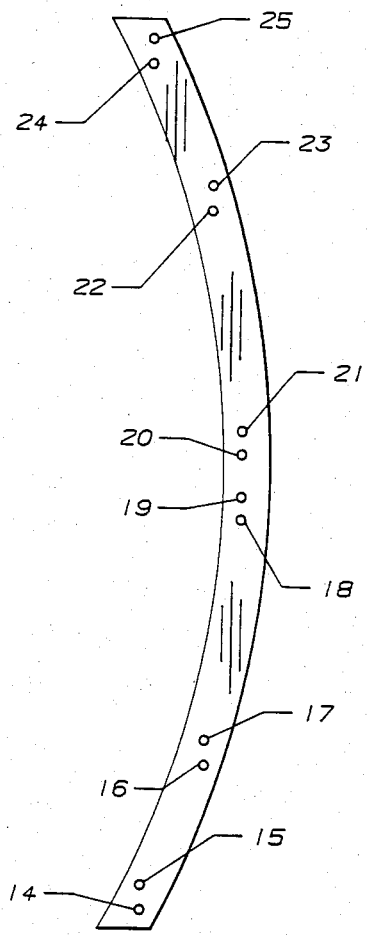
FIG. 4 is an elevational view of a flat face of a typical rib.

A support structure as depicted in FIG. 1 is built of flat ribs as depicted in FIG. 4 and triangular corner gussets as depicted in FIG. 3.

FIG. 1 depicts a support structure built of flat ribs of various sizes, identified as 1, 3, 4, 5 and 6. Each rib has a pair of parallel flat faces displaced one from the other by the uniform thickness of the rib, and, as shown in FIG. 4, each flat face of each rib has a parabolic forward edge. The flat faces of the ribs are on planes that are parallel to the focal axis of the paraboloid, so the focal length of the parabolic forward edge of each flat face of each rib is identical to the focal length of the paraboloid. Sets of four equal-length ribs, identified as 1, 3, 4, and 5, are arranged in concentric square patterns around the focal axis 8 of the paraboloid such that the planes of the flat faces of the four ribs of each set intersect in two squares on a plane perpendicular to focal axis 8. Because these two squares are separated only by the insubstantial thickness of the ribs, each set of four ribs may conveniently be spoken of as forming a single square. The ends of these ribs are beveled so that they fit flat against abutting ribs.

The outermost square in FIG. 1 consists of four identical ribs that are each designated as 1. Additional sets of four identical ribs are arranged such that the ends of ribs 3 and 4 meet the outermost square along the lengths of ribs 1 at forty-five-degree angles and the ends of ribs 5 meet the next outer square, made up of ribs 4, along the lengths of ribs 4 at forty-five-degree angles. Each rib of an additional set is the hypotenuse of an isosceles right triangle, so the lengths of the various ribs are easy to calculate using the Pythagorean Theorem.

Rib 6 extends through the focal axis 8 of the paraboloid between opposite (non-adjacent) ribs 5 in the innermost set of four equal-length ribs having focal axis 8 at its center. The planes of the flat faces of rib 6 meet the planes of the flat faces of these opposing ribs 5 at right angles on a plane perpendicular to focal axis 8.

Figure 2:
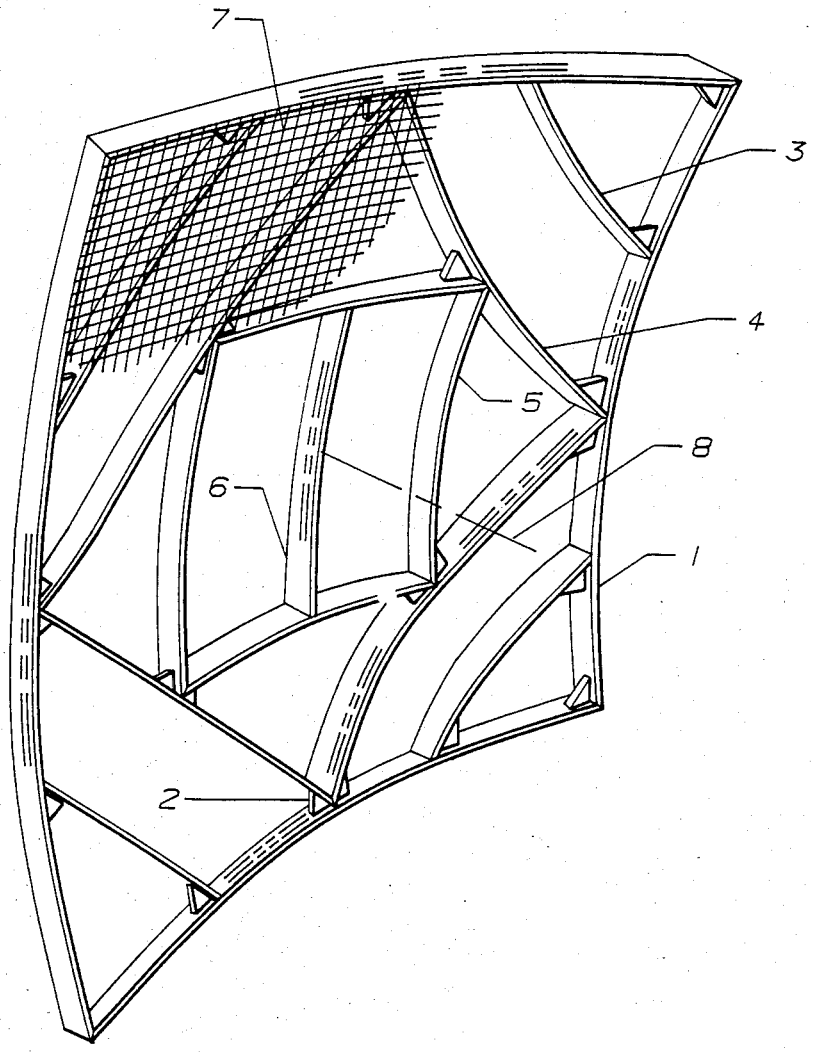
FIG. 2 is a perspective front depiction of the support structure.

The foward edges of the ribs are aligned to form a contoured skeleton upon which a screen reflector, identified as 7, is attached. FIG. 2 generally illustrates the curvature of this contoured skeleton in front perspective. The rib identified as 6 establishes the curvature of the screen at the center of the structure. The surface of the screen tends to flatten toward the center of unsupported areas, so additional ribs may be used if less deviation from a theoretical paraboloid is required.

In FIG. 3, the corners of a corner gusset 2 are labeled in order to facilitate a geometric descripiton of the gussets and their positions in the support structure. Points A, B and C describe a plane segment parallel to that described by points D, E and F. Angles ABC and DEF are ninety degrees. Angles BAC, EDF, BCA and EFD are forty-five degrees. Line segments AD, BE and CF are parallel to each other and perpendicular to plane segments ABC and DEF. Corner gusset 2 has three rectangular flat faces, two designated as surfaces 9, having corners at points BEFC and BEDA, corresponding to the legs of an isosceles right triangle, and one surface 10, having corners at points ADFC, corresponding to the hypotenuse. Each of edges AD, CF and BE is shared by two of the three rectangular flat faces. Each of edges AC, DF, BC, EF, ED and AB is on only one of the three rectangular flat faces.

Figure 5:
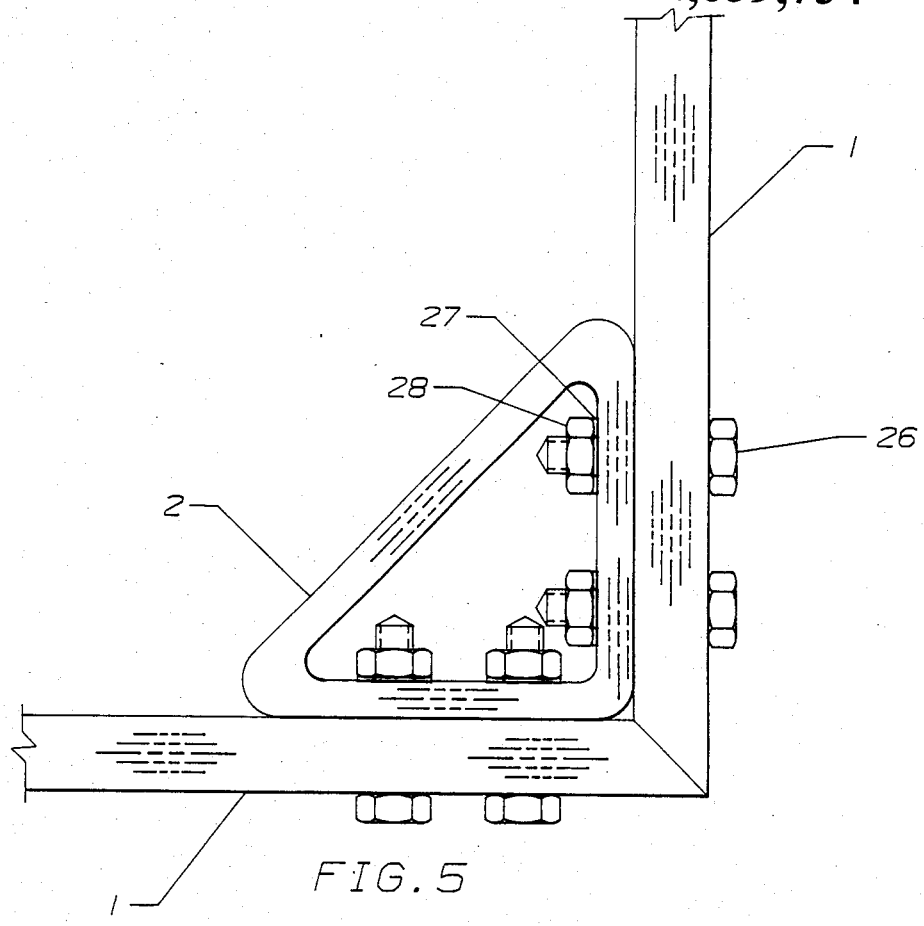
FIGS. 5 and 6 illustrate fasteners for the ribs and corner gussets.
Figure 6:
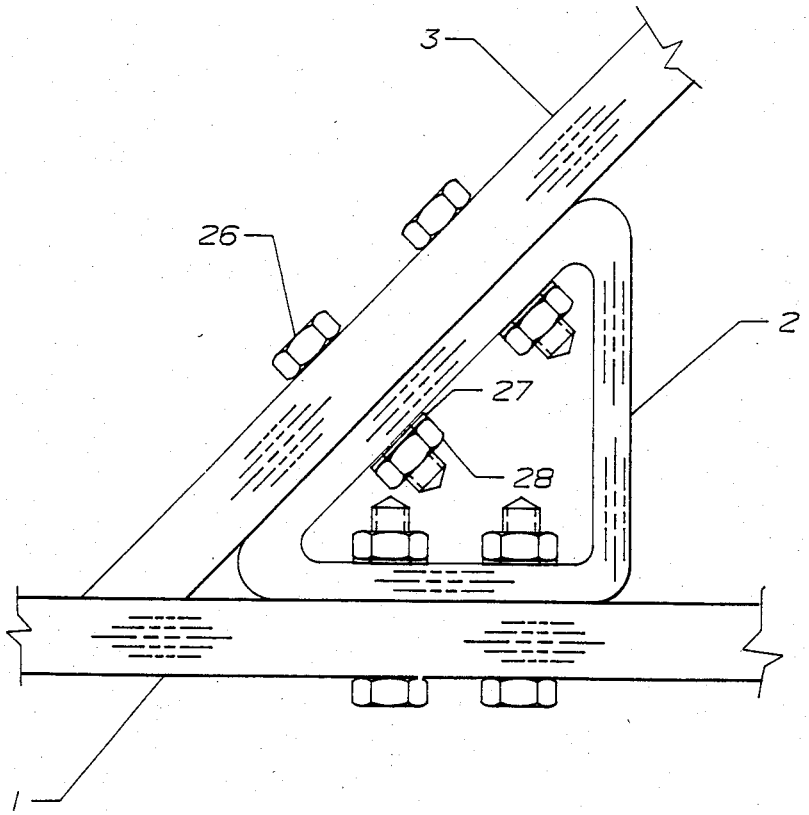

As illustrated in FIG. 4, pairs of holes 14, 15 . . . 24, 25 in the flat faces of the ribs are arranged along parallel lines. This arrangement is made possible by the width of the flat face of the rib. The pairs of holes on the ribs correspond to pairs of holes 11–13 on the flat surfaces 9–10 of the corner gussets (FIG. 3). Fasteners, such as bolt 26, washer 27 and nut 28 (FIGS. 5 and 6), inserted through the corresponding holes hold the corner gussets against the ribs so that the plane segments ABC and DEF of the various braces are aligned on parallel planes. In the completed support structure, those parallel planes are perpendicular to the focal axis of the paraboloid. Identical corner gussets, identified as 2 in FIGS. 1 and 2, thus may be used throughout the support structure.

One realized embodiment of the invention is a support structure for a paraboloid screen reflector in a UHF receiving antenna. A square structure, four feet to a side, was built of plywood ribs and corner gussets, all cut from a four-feet-by-four-feet sheet of one-half-inch plywood. The ribs were cut to a width of two-and-one-half inches along a parabolic curve having a focal length of thirty inches. The corner gussets were cut to isosceles right triangles, four inches to a side. A screen reflector was stapled to the forward edges of the ribs after the structure was screwed together.

I claim:

1. A support structure for a paraboloid reflector comprising:

a plurality of elongated ribs, each rib having a pair of parallel flat faces displaced one from the other by the uniform thickness of the rib, each flat face of each rib having an inwardly curved forward edge, the thickness of each rib being substantially less than the width of the two flat faces of the rib, each flat face of each rib being a segment of a plane parallel to the focal axis of the paraboloid, the forward edges of the flat faces of the ribs defining an inwardly contoured support surface for a reflecting surface, wherein the improvement comprises:

in a plurality of sets of ribs, each set arranged such that the planes of the flat faces of four equal-length ribs intersect in two squares on a plane perpendicular to the focal axis of the paraboloid, the two squares separated by the uniform thickness of the ribs, each square having the focal axis of the paraboloid at its center, the sets of ribs being joined together in the following pattern: a first set of four equal-length ribs having each end of each rib joined to an end of another rib in the set, the first set being an outermost square, within the outermost square there being a plurality of additional nested sets of four equal-length ribs, the plurality including at least a second and third set of ribs, each rib of the second additional set extending between pairs of adjacent ribs in the outermost square, and of the third set extending between pairs of adjacent ribs in the second set, each end of each rib in the additional sets joining a rib in the next outer square along the length of that rib in the next outer square, the planes of the flat faces of each rib in the additional sets intersecting the planes of the flat faces of each rib in the next outer square at forty-five-degree angles on a plane perpendicular to the focal axis of the paraboloid.

2. Support structure as claimed in claim 1, wherein a single rib through the focal axis of the paraboloid extends between a pair of opposite ribs in an innermost set of four equal-length ribs having the focal axis of the paraboloid at the center of the innermost set, the planes of the flat faces of the single rib that extends through the focal axis of the paraboloid meeting the planes of the flat faces of the opposing ribs at right angles on a plane perpendicular to the focal axis of the paraboloid.

3. Support structure as claimed in claim 1, wherein the ribs are held in position by corner gussets in the form of isosceles right triangles, each of said corner gussets comprising:

three rectangular flat faces having the same width, each rectangular face having two parallel edges along the width of the face and two parallel edges along the length of the face, each edge along the width of each rectangular face being shared by another of the three rectangular faces, each edge along the length of each rectangular face being unshared by the other rectangular faces, the edges along the lengths of the three rectangular faces forming two isosceles right triangles separated by the uniform width of the three rectangular faces, each of the two isosceles right triangles being a segment of a plane perpendicular to the focal axis of the paraboloid, each of two of the rectangular faces of the corner gusset having its entire surface on a flat face of one of two adjoining ribs and the other of the two rectangular faces having its entire surface on a flat face of the other of the two adjoining ribs.

4. Support structure as claimed in claim 3, wherein the means of fastening each corner gusset to two adjoining ribs comprises fasteners inserted through matching holes in the ribs and the corner gusset.

* * * * *